US007338427B2

(12) United States Patent
Pitkämäki et al.

(10) Patent No.: US 7,338,427 B2
(45) Date of Patent: Mar. 4, 2008

(54) CENTRIFUGAL SEPARATOR HAVING CLEANING CHANNEL

(75) Inventors: Jouko Juhani Pitkämäki, Tumba (SE); Robert Sandblom, Alvsjo (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 10/581,709

(22) PCT Filed: Dec. 10, 2004

(86) PCT No.: PCT/SE2004/001844

§ 371 (c)(1),
(2), (4) Date: Jun. 5, 2006

(87) PCT Pub. No.: WO2005/056196

PCT Pub. Date: Jun. 23, 2005

(65) Prior Publication Data

US 2007/0117706 A1 May 24, 2007

(30) Foreign Application Priority Data

Dec. 11, 2003 (SE) ..... 030333

(51) Int. Cl.
*B04B 11/08* (2006.01)
*B04B 15/06* (2006.01)

(52) U.S. Cl. ..... 494/56

(58) Field of Classification Search ..... 494/27–30, 494/56–59, 68–73
See application file for complete search history.

(56) References Cited

U.S. PATENT DOCUMENTS

| | | | | |
|---|---|---|---|---|
| 3,317,126 | A * | 5/1967 | Little et al. | 494/27 |
| 4,718,886 | A * | 1/1988 | Mackel | 494/58 |
| 4,729,759 | A | 3/1988 | Krook et al. | |
| 4,784,635 | A | 11/1988 | Bruning et al. | |
| 5,041,075 | A | 8/1991 | Bruning et al. | |
| 5,104,371 | A | 4/1992 | Ajnefors | |
| 6,080,098 | A | 6/2000 | Borgstrom et al. | |
| 6,319,186 | B1 | 11/2001 | Pitkamaki | |
| 7,041,045 | B2 * | 5/2006 | Thiemann | 494/56 |
| 2007/0117706 | A1 * | 5/2007 | Pitkamaki et al. | 494/56 |

FOREIGN PATENT DOCUMENTS

| | | |
|---|---|---|
| DE | 4106874 A1 * | 9/1992 |
| DE | A-19800653 | 7/1999 |
| SE | B-427248 | 1/1982 |

* cited by examiner

*Primary Examiner*—Charles E. Cooley
(74) *Attorney, Agent, or Firm*—Michaud-Duffy Group LLP

(57) ABSTRACT

In a centrifugal separator for separating a product to a heavy phase and a light phase. The centrifuge rotor encloses a separating space. An inlet channel permits feeding of the product to the separating space. A first outlet channel permits discharge of the heavy phase from the separating space. The second outlet channel permits discharge of the light phase from the separating space. The centrifuge rotor includes a first chamber for collecting the heavy phase, a heavy phase channel, for feeding the heavy phase, and a nozzle member between the heavy phase channel and the first chamber for controlled feeding. The first paring member extends outwardly in the first chamber from the first outlet channel for discharge of the heavy phase. The second paring member extends outwardly in the first chamber.

9 Claims, 3 Drawing Sheets

CENTRIFUGAL SEPARATOR HAVING CLEANING CHANNEL

FIELD OF THE INVENTION

The present invention refers to a centrifugal separator for separating a product to at least a relatively heavy phase and a relatively light phase, wherein the centrifugal separator includes a centrifuge rotor, which is rotatable about a rotary axis and includes a rotor wall enclosing a separating space, at least an inlet channel, which extends through the rotor wall and is arranged to permit, during an operation state for the centrifugal separator, feeding of the product to the separating space, a first outlet channel, which extends through the rotor wall and is arranged to permit, during said operation state, discharging of the heavy phase from the separating space, and a second outlet channel, which extends through the rotor wall and is arranged to permit, during said operation state, discharging of the light phase from the separating space, wherein the centrifuge rotor includes a first chamber for collecting the heavy phase, at least one heavy phase channel, which extends from a radially outer area of the separating space to the first chamber for feeding the heavy phase from the radially outer area to the first chamber, and at least one nozzle member, which is provided between the heavy phase channel and the first chamber for creating a controlled feeding of the heavy phase from the heavy phase channel to the first channel, wherein a first paring member extends outwardly in the first chamber from the first outlet channel and includes an outer orifice for discharging the heavy phase from the first chamber out of the centrifuge rotor via the outer orifice of the first paring member.

BACKGROUND OF THE INVENTION

Such a centrifugal separator is known from U.S. Pat. No. 6,319,186. The known centrifugal separator has a centrifuge rotor which is rotatable about a rotary axis. The rotor includes a rotor wall enclosing an inner separating space. A stationary pipe member extends through the rotor wall into the separating space. The pipe member includes an inlet channel for feeding of the product to the inner space, a first outlet channel for discharging the relatively heavy phase from the inner space, and a second outlet channel for discharging the relatively light phase from the separating space. A first chamber is provided in the rotor for collecting the relatively heavy phase. A heavy phase channel extends from a radially outer area of the separating space to the first chamber for feeding the relatively heavy phase from the radially outer area to the first chamber. A nozzle member is provided between the heavy phase channel and the first chamber for creating a controlled feeding of the relatively heavy phase from the heavy phase channel to the first chamber. A paring pipe extends outwardly in the first chamber to an outer orifice and is connected to the first outlet channel for discharging the relatively heavy phase from the first chamber out of the centrifuge rotor via the outer orifice of the paring pipe. The paring pipe is provided in a lower part of the centrifuge rotor.

SE-B-427 248 discloses different kinds of centrifugal separators for separating a product to a relatively heavy phase and a relatively light phase. The separators disclosed have a centrifuge rotor with a permanently open outlet for the separated relatively heavy phase. In order to provide an automatic control of the flow of the relatively heavy phase, a nozzle member in the form of a vortex nozzle is provided at the outlet opening. The vortex nozzle is a type of vortex fluidistor, which does not separate the incoming product but controls the flow by increasing the latter when the viscosity of the liquid increases and decreases the flow when the viscosity of the liquid decreases. Such an automatic flow control creates a throttling of the flow without leading to a too small flow area which could involve a risk for clogging of the nozzle.

In certain centrifugal separators, the relatively heavy phase, which for instance may be a sludge-like product such as yeast and which is collected in the radially outermost part of the inner separating space, is discharged out of the centrifuge rotor via one or several heavy phase channels and via a vortex nozzle of the type mentioned above. The vortex nozzle has the property of decreasing the flow resistance there through, the higher the viscosity of the relatively heavy phase is (the higher the sludge-concentration of the sludge is). The rotation of the relatively heavy phase in the vortex nozzle and thus the flow-resistance of the vortex nozzle decreases with increasing viscosity of the heavy phase. This means that the discharge of the relatively heavy phase through a heavy phase channel having such a vortex nozzle to a certain extent is self-controlling.

During internal cleaning of rotors with discharge channels of this kind and without de-mounting of the rotor, so called Cleaning In the vortex nozzles limit however the flow of the cleaning liquid having a low viscosity through the heavy phase channels and adjacent spaces.

SUMMARY OF THE INVENTION

The object of the present invention is to remedy the problems mentioned above and to enable an improved cleaning of the centrifuge rotor. Especially it is aimed at an improved cleaning of the heavy phase channel, the nozzle member and adjacent spaces.

This object is achieved by the centrifugal separator as initially defined and further including a second paring member, which extends outwardly in the first chamber to an outer orifice and which is arranged to permit, during a cleaning state, feeding of a cleaning liquid from the first chamber to the heavy phase channel via the outer orifice of the second paring member.

During internal cleaning of the rotor, at least a part of the cleaning liquid may in such a centrifugal separator be supplied rearwardly through the first paring member for the heavy phase with such a large flow that the first chamber is filled up radially inwardly, and reaches the outer orifice of the second paring member. The cleaning liquid will then be conveyed into the second paring member, which feeds the cleaning liquid to the first channel. Thus, the outer orifice of the first paring member may be located at a larger distance from the rotary axis than the outer orifice of the second paring member. Consequently, it is possible to ensure that the orifice of the second paring member normally does not reach the heavy phase during the operation state. Only if the discharge of the heavy phase through the first outlet channel is stopped, the heavy phase can reach the outer orifice of the second paring member. It is thus possible to use the second paring member also as a security device preventing overfill of the first chamber at a stop in the first outlet channel.

According to an embodiment of the invention, the centrifuge rotor includes at least one nozzle chamber, in which the nozzle member is provided, and a passage which extends from the first chamber to the nozzle chamber, wherein said passage is arranged to permit, during said cleaning state, supply of a cleaning liquid from the first chamber to the nozzle chamber for external cleaning of the nozzle member.

In such a way, the nozzle member may be supplied with cleaning liquid both rearwardly and from the outside, and an efficient cleaning of the nozzle member may be ensured.

According to a further embodiment of the invention, the second paring member has an inner orifice and is arranged to convey, during said cleaning state, the cleaning liquid from the first chamber to said passage via the inner orifice.

According a further embodiment of the invention, said passage includes a collecting chamber for cleaning liquid and at least one cleaning channel, which extends outwardly from the collecting chamber to the nozzle chamber. The collecting chamber may be provided in the proximity of the rotary axis and extend around the rotary axis, wherein the collecting member may have an opening, which is provided immediately in the proximity of the inner orifice of the second paring member. During said cleaning state, the cleaning liquid will thus flow in through the outer orifice of the second paring member, through the second paring member and out through the inner orifice. From there, the cleaning liquid flows over into the collecting chamber and out of the collecting chamber through the cleaning channel to the nozzle chamber. In the nozzle chamber, the cleaning liquid flows around the outer side of the nozzle device and passes the nozzle member rearwardly through the heavy phase channel and out into the radially outer area of the separating space.

According to a further embodiment of the invention, the first chamber is located in an upper part of the centrifuge rotor, wherein the collecting chamber is provided immediately beneath the first chamber. The cleaning liquid may thus flow down from the inner orifice of the second paring member substantially directly to the collecting chamber.

According to a further embodiment of the invention, the nozzle member includes a vortex nozzle having a vortex fluidistor.

BRIEF DESCRIPTION OF THE DRAWINGS

The present invention is now to be described more closely through a description of various embodiments, shown by way of example, and with a reference to the drawings attached, in which FIG. 1 schematically illustrates a partly sectional side-view of a centrifugal separator according to the invention.

DETAILED DESCRIPTION OF VARIOUS EMBODIMENTS OF THE INVENTION

Figure 1:
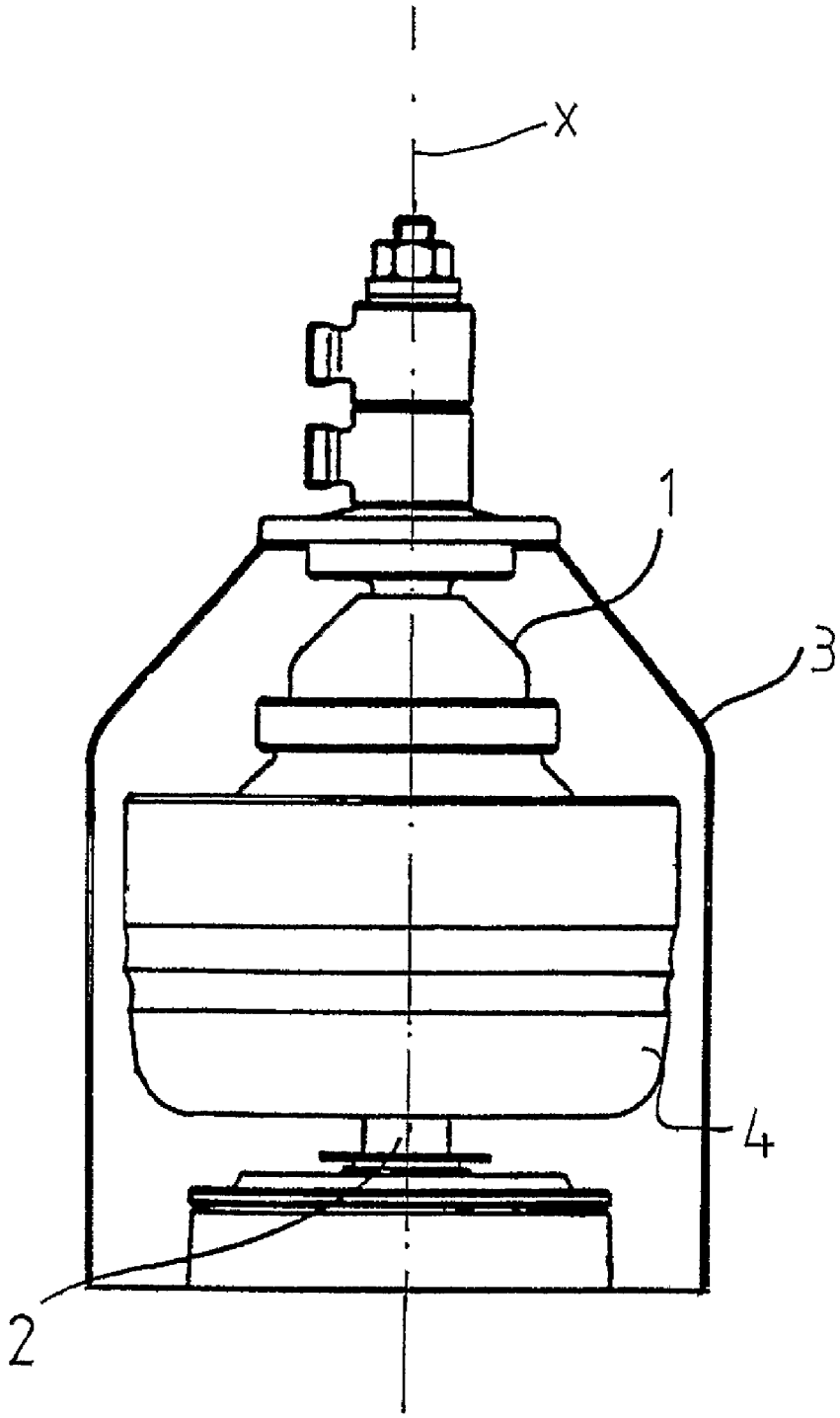

FIG. 1 discloses a centrifugal separator for separating, during an operation state, a product to a relatively heavy phase and a relatively light phase. The centrifugal separator includes a centrifuge rotor 1, which in the following is called the rotor 1 and which is carried by a substantially vertical spindle 2. The spindle 2 with the rotor 1 is rotatable about a rotary axis x during said operation state. Furthermore, the centrifugal separator includes a substantially stationary frame which is illustrated by and includes a casing 3 for the rotor 1. The spindle 2 is journalled in said frame by means of an upper and a lower bearing, not disclosed. Furthermore, the spindle 2 is connected to a drive member, not disclosed, which is arranged to a rotate the rotor 1 at a high rotary speed during said operation state.

Figure 2:
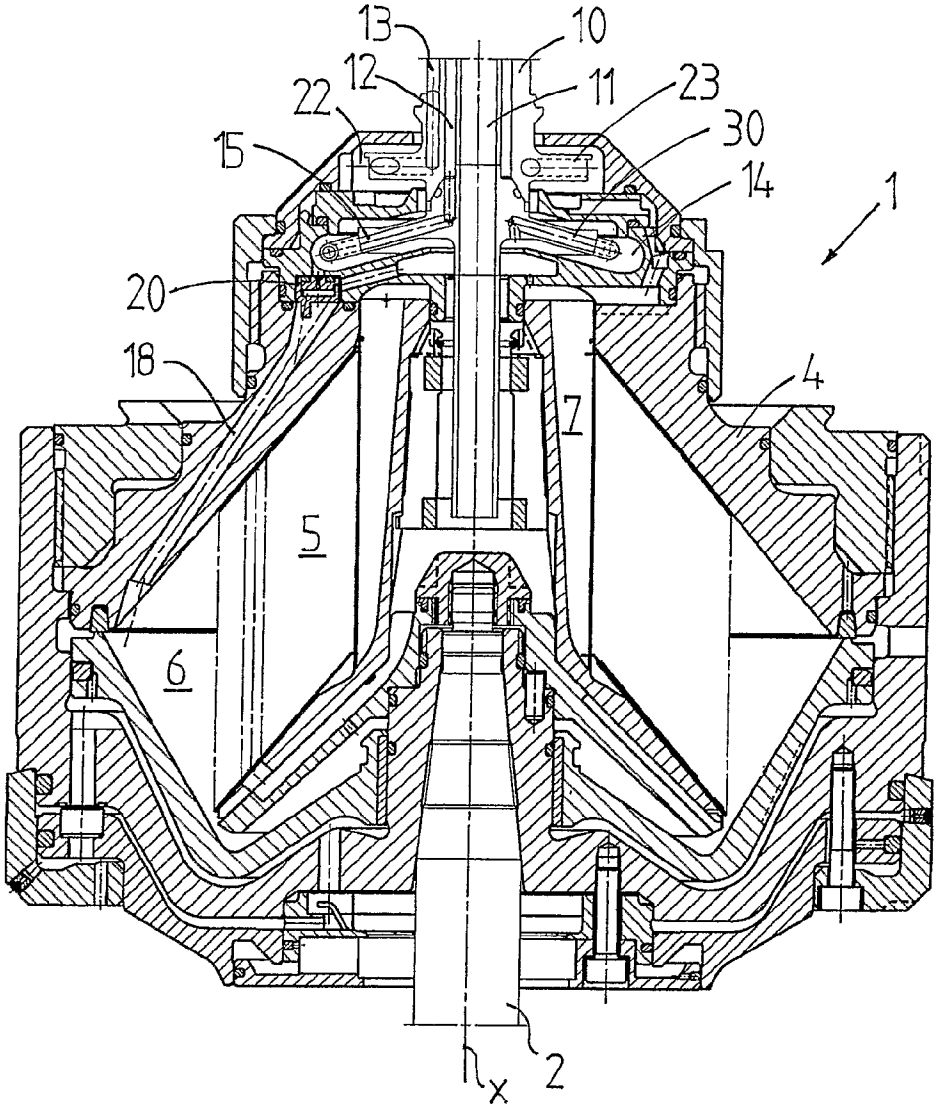
FIG. 2 is an axial section through a rotor of the centrifugal separator in FIG. 1.

The rotor 1 includes a rotor wall 4, which defines an outer periphery of the rotor 1 and includes an inner space forming a separating space 5, see FIG. 2. During said operation state, the product introduced will be separated, wherein the relatively heavy phase is collected in a radially outer area 6 of the separating space 5 and the relatively light phase is collected in a central area 7 of the separating space 5.

Furthermore, the centrifugal separator includes a stationary pipe member 10, which extends downwardly through the rotor wall 4 into the separating space 5. The stationary pipe member 10 includes and encloses an inlet channel 11, a first outlet channel 12 and a second outlet channel 13. The inlet channel 11 is arranged to permit, during said operation state, feeding of the product to the separating space 5. The inlet channel 11 extends substantially vertically through the rotor wall 4 to a central position in the separating space 5.

The first outlet channel 12 is arranged to permit, during said operation state, discharge of the heavy phase from the separating space 5. The second outlet channel 12 extends substantially vertically upwardly through the rotor wall 4 from a first chamber 14 for collecting the heavy phase. The first chamber 14 is provided in an upper part of the rotor 1. A stationary first parting member in the form of a paring disc or a paring pipe 15, as in the embodiment disclosed, is connected to the pipe member 10 and to the first outlet channel 12. The first paring pipe 15 extends outwardly in the first chamber 14 from the pipe member 10 and has an outer orifice 16.

The rotor 1 includes as least one heavy phase channel 18, which extend from the radially outer area 6 of the separating space 5 to the first chamber 14 for feeding the heavy phase from the radially outer area 6 to the first chamber 14. It is to be noted that the rotor 1 may include several heavy phase channels 18, which are uniformly distributed along the periphery of the rotor 1. Each heavy phase channel 18 extends obliquely upwardly and inwardly to the first chamber 14 for forming a suitable angle facilitating the transport of the heavy phase to the first chamber 14. Between each heavy phase channel 18 and the first chamber 14, there is a nozzle chamber 19 in which a nozzle member 20 is provided. The nozzle member 20 includes a so-called vortex nozzle creating a controlled feeding of the heavy phase from the heavy phase channel 18 to the first chamber 14. The vortex nozzle includes a vortex fluidistor, which has a peripheral inlet and a central outlet and the property of decreasing the flow resistance through the nozzle member 20 with increasing viscosity.

The second outlet channel 13 is arranged to permit, during said operation state, discharge of the light phase from the separating space 5. Also the second outlet channel 13 extends substantially vertically upwardly in the pipe member 10 through the rotor wall 4 from a second chamber 22 for collecting the light phase. The second chamber 22 is also provided in the upper part of the rotor 1 and in the embodiment disclosed above the first chamber 14. The stationary paring member in the form of a paring pipe or a paring disc 23, as in the embodiment disclosed, is connected to the pipe member 10 and the second outlet channel 13. The paring disc 23 includes an outer orifice 24 in the second chamber 22. A light phase channel 25, see specially FIG. 3, extends between the central area 7 of the separating space 5 and the second chamber 22, wherein the light phase will be fed from the central area 7 to the second chamber 22. From the second chamber 22, the light phase will be fed into the second outlet channel 13 via the paring disc 23 in a manner known per se and then further out of the rotor 1.

In order to achieve an efficient internal cleaning of the rotor, the centrifugal separator includes according to the invention a second paring member, in the form of a paring disc or a paring pipe 30 as in the embodiment disclosed. The second paring pipe 30 is provided in the first chamber 14. The second paring pipe 30 is also stationary and attached to the pipe member 10. The second paring pipe 13 has an outer orifice 31 and an inner orifice 32 and extends outwardly in the first chamber 14 to an outer orifice 31. The outer orifice 16 of the first paring pipe 15 is located at a larger distance from the rotary axis x than the outer orifice 31 of the second paring pipe 30. During normal operation, the outer orifice 31 of the second paring pipe 30 will thus not reach the heavy phase collected in a radially outer part of the first chamber 14.

The rotor 1 includes a passage extending from the first chamber 14 to the nozzle chamber 19. During cleaning of the rotor, a cleaning liquid is supplied and fed via the first outlet channel 12 and the first paring pipe 15. The first chamber 14 is then filled with cleaning liquid until the level of the liquid reaches the outer orifice 31 of the second paring pipe 30. The second paring pipe 30 is thus arranged to permit, during a cleaning state, feeding of cleaning liquid from the first chamber 14 to the nozzle chamber 19 and the heavy phase channel 18 via the outer orifice 31, the second paring pipe 30, the inner orifice 32 and said passage. Said passage includes a collecting chamber 35 for cleaning liquid and at least a cleaning channel 36 extending outwardly from the collecting chamber 35 to the nozzle chamber 19. The collecting chamber 35 is provided in the proximity of the pipe member 10 immediately beneath the first chamber 14. The collecting chamber 35 extends around the pipe member 10 and the rotary axis x. The collecting chamber 35 has an opening 37, which also extends around the pipe member 10 and which is provided immediately in the proximity of the inner orifice 32 of the second paring pipe 30.

During said operation state, the product is fed into the rotating rotor 1 via the inlet channel 11 to a central position in the separating space 5. Due to the rotation of the rotor 1, the phase, which for instance may be a liquid, will be collected in the central area 7 and from there be discharged from the rotor 1 via the light phase channel 25, the second chamber 22, the paring disc 23 and the second outlet channel 13, see the continuous arrows in FIG. 3. The heavy phase, which for instance may be sludge, is collected in the radially other area 6 and will be fed obliquely upwardly through the heavy phase channel or channels 18 extending from the radially outer area 6. The heavy phase is then fed into a respective vortex nozzle 20 at the periphery of the vortex nozzle 20 and out at its centre. From the vortex nozzle 20, the heavy phase then flows into the common first chamber 14. Due to the rotation of the rotor 1, the heavy phase will be collected in a radially outer part of the first chamber 14 and when the level of the heavy phase reaches the outer orifice 16 of the first paring pipe 15, the heavy phase will be fed into the first paring pipe 15 and out of the rotor 1 via the first outlet channel 12.

Figure 3:
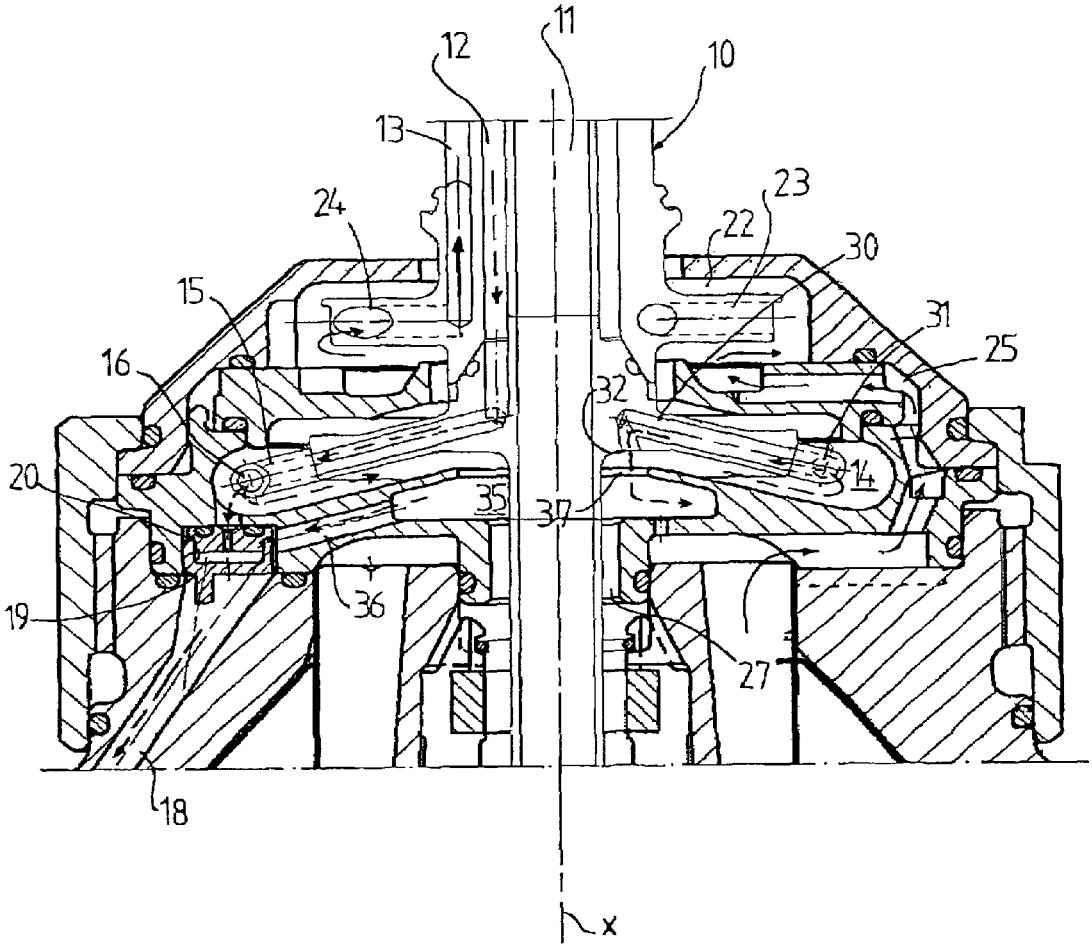
FIG. 3 is an axial section through a part of the rotor in FIG. 1.

During said cleaning state, no product is fed into the rotor 1, but a cleaning liquid is fed into the rotating rotor 1 via the first outlet channel 12. The cleaning liquid, see the dashed arrows in FIG. 3, is fed into the first chamber 14 via the outer orifice 16 of the first paring pipe 15 and fills up due to the rotation of the rotor 1 the first chamber 14 radially from an outer position so far that the level of the cleaning liquid reaches the outer orifice 31 of the second paring pipe 30. The cleaning liquid will thus be conveyed through the second paring pipe 30 out through the inner orifice 32. From there, the cleaning liquid is conveyed directly down into the collecting chamber 35 via the opening 37 and out to one or several of the nozzle chambers 19 via a respective cleaning channel 36. The cleaning liquid reaches via the cleaning channels 36 thus the nozzle members 20 from outside and at the same time the interior of the nozzle members 20 via the first chamber 14. From the nozzle chambers 19, the cleaning liquid is conveyed out to the radially outer area 6 via a respective heavy phase channel 18.

The solution disclosed also has a security function during the above-mentioned normal operation state of the centrifugal separator. If for any reason there is a stop in the first outlet channel 12, the heavy phase, which is collected in the first chamber 14 and flows over the radially inner edge of the lower end wall of the first chamber, i.e. the opening 37, will be caught by the collecting chamber 35 and conveyed out to the heavy phase channel or channels 18 via the cleaning channel or channels 36. Hereby the heavy phase located in the cleaning channel or channels 36 and the collecting chamber 35, will act with a successively stronger counter-pressure in the heavy phase channel or channels 18 which then results in the function that no more heavy phase will flow into the first chamber 14 but merely the light phase will flow out of the rotor 1 with an increasing content of heavy phase.

The invention is not limited to the embodiment disclosed but may be varied and modified within the scope of the following claims. For instance, the second chamber 22 may be provided below the first chamber 14. Furthermore, it is possible to provide the first chamber 14 in a lower part of the rotor 1.

The invention claimed is:

1. A centrifugal separator for separating a product to at least a relatively heavy phase and a relatively light phase, wherein the centrifugal separator includes:

a centrifuge rotor, rotatable about a rotary axis and a rotor wall enclosing a separating space, at least an inlet channel, which extends through the rotor wall and is arranged to permit, during an operating state for the centrifugal separator, feeding of the product to the separating space, a first outlet channel, which extends through the rotor wall and is arranged to permit, during said operating state, discharging of the heavy phase from the separating space, and a second outlet channel, which extends through the rotor wall and is arranged to permit, during said operation state, discharging of the light phase from the separating space, the centrifuge rotor further including a first chamber for collecting the heavy phase, at least one heavy phase channel, which extends from a radially outer area of the separating space to the first chamber for feeding the heavy phase from the radially outer area to the first chamber, and at least one nozzle member, which is provided between the heavy phase channel and the first chamber for creating a controlled feeding of the heavy phase from the heavy phase channel to the first channel, wherein a first paring member extending outwardly in the first chamber from the first outlet channel and including an outer orifice for discharging the heavy phase from the first chamber out of the centrifuge rotor via the outer orifice of the first paring member, the centrifuge rotor including a second paring member, extending outwardly in the first chamber to an outer orifice and which is arranged to permit, feeding of a cleaning liquid from the first chamber to the heavy phase channel via the outer orifice of the second paring member.

2. A centrifugal separator according to claim 1, wherein the outer orifice of the first paring member is located at a larger distance from the rotary axis than the outer orifice of the second paring member.

3. A centrifugal separator according to claim 1, the centrifuge rotor includes at least one nozzle chamber, in which the nozzle member is provided, and a passage, which extends from the first chamber to the nozzle chamber, wherein said passage is arranged to permit, during a cleaning state, supply of a cleaning liquid from the first chamber to the nozzle chamber for external cleaning of the nozzle member.

4. A centrifugal separator according to claim 3, wherein the second paring member has an inner orifice and is arranged to convey, during said cleaning state, the cleaning liquid from the first chamber to said passage via the inner orifice.

5. A centrifugal separator according to claim 3, wherein said passage includes a collecting chamber for cleaning liquid and at least one cleaning channel, which extends outwardly from the collecting chamber to the nozzle chamber.

6. A centrifugal separator according to claim 5, wherein the collecting chamber is provided in the proximity of the rotary axis and extends around the rotary axis.

7. A centrifugal separator according to claim 6, wherein the collecting chamber has an opening, provided immediately in the proximity of an inner orifice of the second paring member.

8. A centrifugal separator according to claim 7, wherein the first chamber is located in an upper part of the centrifuge rotor, wherein the collecting chamber is provided immediately beneath the first chamber.

9. A centrifugal separator according to claim 1, wherein the nozzle member includes a vortex nozzle having a vortex fluidistor.

* * * * *